US011670891B2

(12) United States Patent
Asano et al.

(10) Patent No.: US 11,670,891 B2
(45) Date of Patent: Jun. 6, 2023

(54) ELECTRICAL CONNECTOR WITH WATER EVACUATION FEATURES AND CONNECTOR DEVICE USING THE SAME

(71) Applicant: HOSIDEN CORPORATION, Osaka (JP)

(72) Inventors: Takao Asano, Gunma (JP); Shuya Yokobori, Gunma (JP); Yutaka Sanda, Gunma (JP); Koji Minami, Gunma (JP); Tatsuya Morishita, Gunma (JP)

(73) Assignee: HOSIDEN CORPORATION, Osaka (JP)

( * ) Notice: Subject to any disclaimer, the term of this patent is extended or adjusted under 35 U.S.C. 154(b) by 0 days.

(21) Appl. No.: 17/474,483

(22) Filed: Sep. 14, 2021

(65) Prior Publication Data

US 2022/0094102 A1 Mar. 24, 2022

(30) Foreign Application Priority Data

Sep. 18, 2020 (JP) ..... JP2020-157141
Feb. 2, 2021 (JP) ..... JP2021-014820

(51) Int. Cl.
*H01R 13/52* (2006.01)
*H01R 12/72* (2011.01)
(Continued)

(52) U.S. Cl.
CPC ..... *H01R 13/5227* (2013.01); *H01R 12/72* (2013.01); *H01R 13/6581* (2013.01);
(Continued)

(58) Field of Classification Search
CPC ..... H01R 13/5227; H01R 12/72; H01R 13/6581; H01R 13/502; H01R 12/724;
(Continued)

(56) References Cited

U.S. PATENT DOCUMENTS

2014/0315421 A1 10/2014 Lu et al.
2016/0049756 A1* 2/2016 Yen ..... H01R 13/6585 439/676

FOREIGN PATENT DOCUMENTS

WO 2018/168352 A1 9/2018

OTHER PUBLICATIONS

Extended European Search Report from European Patent Application No. 21196872.2.

* cited by examiner

*Primary Examiner* — Abdullah A Riyami
*Assistant Examiner* — Justin M Kratt
(74) *Attorney, Agent, or Firm* — Dilworth & Barrese, LLP

(57) ABSTRACT

A connector and a connector device that are small and have a drainage function are provided. A connector includes: a contact; a first insulator; a first shield member; a second shield member having a tubular portion; and a second insulator. A first communicating portion that is in communication with the outside is formed in a lower wall of the tubular portion of the second shield member, the lower wall facing the second insulator. A second communicating portion that is in communication with the outside and the first communicating portion is formed in the second insulator. The first shield member has a facing wall that faces the first communicating portion, and a bent wall that is bent toward the second insulator from an end portion of the facing wall on an opposite side to the opening side.

20 Claims, 9 Drawing Sheets

(51) Int. Cl.

| | |
|---|---|
| ***H01R 13/6581*** | (2011.01) |
| *H01R 107/00* | (2006.01) |
| *H01R 24/60* | (2011.01) |
| *H01R 13/502* | (2006.01) |
| *H01R 13/6594* | (2011.01) |

(52) U.S. Cl.
CPC ..... *H01R 12/724* (2013.01); *H01R 13/502* (2013.01); *H01R 13/52* (2013.01); *H01R 13/6594* (2013.01); *H01R 24/60* (2013.01); *H01R 2107/00* (2013.01); *H01R 2201/26* (2013.01)

(58) Field of Classification Search
CPC ..... H01R 13/6594; H01R 24/60; H01R 2107/00; H01R 2201/26; H01R 13/52
See application file for complete search history.

ELECTRICAL CONNECTOR WITH WATER EVACUATION FEATURES AND CONNECTOR DEVICE USING THE SAME

CROSS REFERENCE TO RELATED APPLICATION

This application is based on and claims priority under 35 U.S.C. Section 119 to Japanese Patent Applications No. 2020-157141 filed on Sep. 18, 2020 and No. 2021-14820 filed on Feb. 2, 2021, the entire content of which are incorporated herein by reference.

TECHNICAL FIELD

This disclosure relates to a connector to be mounted on a substrate and a connector device.

BACKGROUND ART

Conventionally, a small connector (receptacle) supporting Type-C of the USB standard is known as an example of a connector to be mounted on a substrate (e.g., see WO2018/168352A1). Type-C of the USB standard is a next-generation standard that enables high-speed charging and high-speed communication, and small receptacles supporting Type-C are installed in connector devices for a charger or the like, in smartphones, vehicles, and so on.

A connector (receptacle) described in WO2018/168352A1 includes contacts (electrodes in the document) to be electrically connected to a plug, an insulator (a tongue part formed on a substrate in the document) that holds the contacts, and a tubular shield member (a case in the document) that covers the insulator. This case has a shell part that covers the tongue part, and a first folded-back part and a second folded-back part that are folded back inward respectively from an upper end portion and a lower end portion of the shell part, and the tongue part is arranged between the first and second folded-back parts. The first and second folded-back parts function as EMC (electromagnetic compatibility) pads for shielding the plug.

SUMMARY

Generally, receptacles installed in smartphones are waterproofed such that water does not enter the device, but receptacles installed in vehicles are frequently reused before the infiltrated water dries, and it is therefore preferable to waterproof the receptacle by means of drainage. However, the receptacle described in WO2018/168352A1 does not have a drainage function. In particular, small receptacles such as those supporting Type-C have a small space within the case, and the surface tension of water makes drainage difficult.

Therefore, there is a desire for a connector and a connector device that are small and have a drainage function.

In view of the foregoing, a connector as one mode includes: a contact to be electrically connected to an object to be connected; a first insulator that holds the contact; a first shield member that covers the first insulator; a second shield member that comes into contact with an outer face of the first shield member and has a tubular portion having an opening into which the object to be connected is to be inserted; and a second insulator arranged on an outer side of the second shield member, wherein a first communicating portion that is in communication with an outside is formed in a lower wall of the tubular portion of the second shield member, the lower wall facing the second insulator, a second communicating portion that is in communication with the outside and the first communicating portion is formed in the second insulator, and the first shield member has a facing wall that faces the first communicating portion, and a bent wall that is bent toward the second insulator side from an end portion of the facing wall on an opposite side to the opening.

In this mode, when the connector is mounted on a substrate with the second insulator arranged on a side closer to the substrate than the second shield member, flux used for soldering or solder balls can be prevented from entering the second shield member when the contact or the like of the connector is connected to the substrate since the second insulator is provided on the outer side with respect to the second shield member. In addition, since the first communicating portion that is in communication with the outside is formed in the lower wall of the second shield member, and the second communicating portion that is in communication with the outside and the first communicating portion is formed in the second insulator, water that enters from the opening of the tubular portion of the second shield member when the second insulator is used while being arranged on the gravity direction side with respect to the second shield member can be drained to the outside from the second shield member via the first and second communicating portions.

Moreover, since the first shield member has the facing wall that faces the first communicating portion, water that enters from the opening of the tubular portion is blocked by the facing wall, and can be drained to the outside from the first and second communicating portions while suppressing entry of water to the contact side. Since the first shield member has the bent wall that is bent toward the second insulator side from the end portion of the facing wall on the opposite side to the opening, water that moves along the facing wall can be guided to the first and second communicating portions by the bent wall.

Due to a simple mode in which the first and second communicating portions are provided in the second shield member and the second insulator, respectively, and the bent wall is provided in the first shield member as described above, it is possible to provide a connector that is small but has a function of preventing entry of flux or the like and a drainage function.

It is preferable that the lower wall of the second shield member is provided with an inclined wall that is inclined toward the second insulator side while extending from the opening side of the first communicating portion toward the opposite side.

If, as in this mode, the lower wall of the second shield member is provided with an inclined wall that is inclined toward the second insulator side while extending from the opening side toward the opposite side, water guided by the inclined wall smoothly falls, and can thus be reliably drained from the first and second communicating portions.

It is preferable that a step portion that is bent toward the second insulator side is formed in the facing wall.

If, as in this mode, the facing wall is provided with a step portion, water that moves along the facing wall is guided toward the second insulator side by the step portion, and can thus be smoothly drained from the first and second communicating portions.

It is preferable that the bent wall extends to the outside with respect to the second communicating portion.

If, as in this mode, the bent wall extends to the outside with respect to the second communicating portion, when the connector is mounted on a substrate having a hole for the bent wall to enter, water is drained from the bent wall through the hole, and can thus be prevented from entering between the connector and the substrate.

It is preferable that the facing wall and the bent wall include hydrophilic surfaces.

If, as in this mode, the surfaces of the facing wall and the bent wall are hydrophilic, water is likely to be attracted to the surfaces of the facing wall and the bent wall, and can be reliably drained from the first and second communicating portions.

As one mode, a connector device that includes any of the above-described connectors includes: a substrate on which the connector is mounted and in which an open hole that is in communication with the first communicating portion and the second communicating portion is formed; and a case that supports the substrate on an opposite side to a side on which the connector is mounted, wherein the case has a suction path that suctions water drained from the open hole utilizing a capillary phenomenon, and the water is drained out of the case via the suction path.

In this mode, since a suction path is provided that suctions water drained from the open hole in the substrate by means of the capillary phenomenon, water guided to the first and second communicating portions by the bent wall of the connector can be forcibly suctioned from the open hole via the suction path. Since the water suctioned by the suction path is quickly drained out of the case, it is possible to prevent inconveniences such as water staying within the connector, the substrate, or the case.

DESCRIPTION OF EMBODIMENTS

Figure 1:
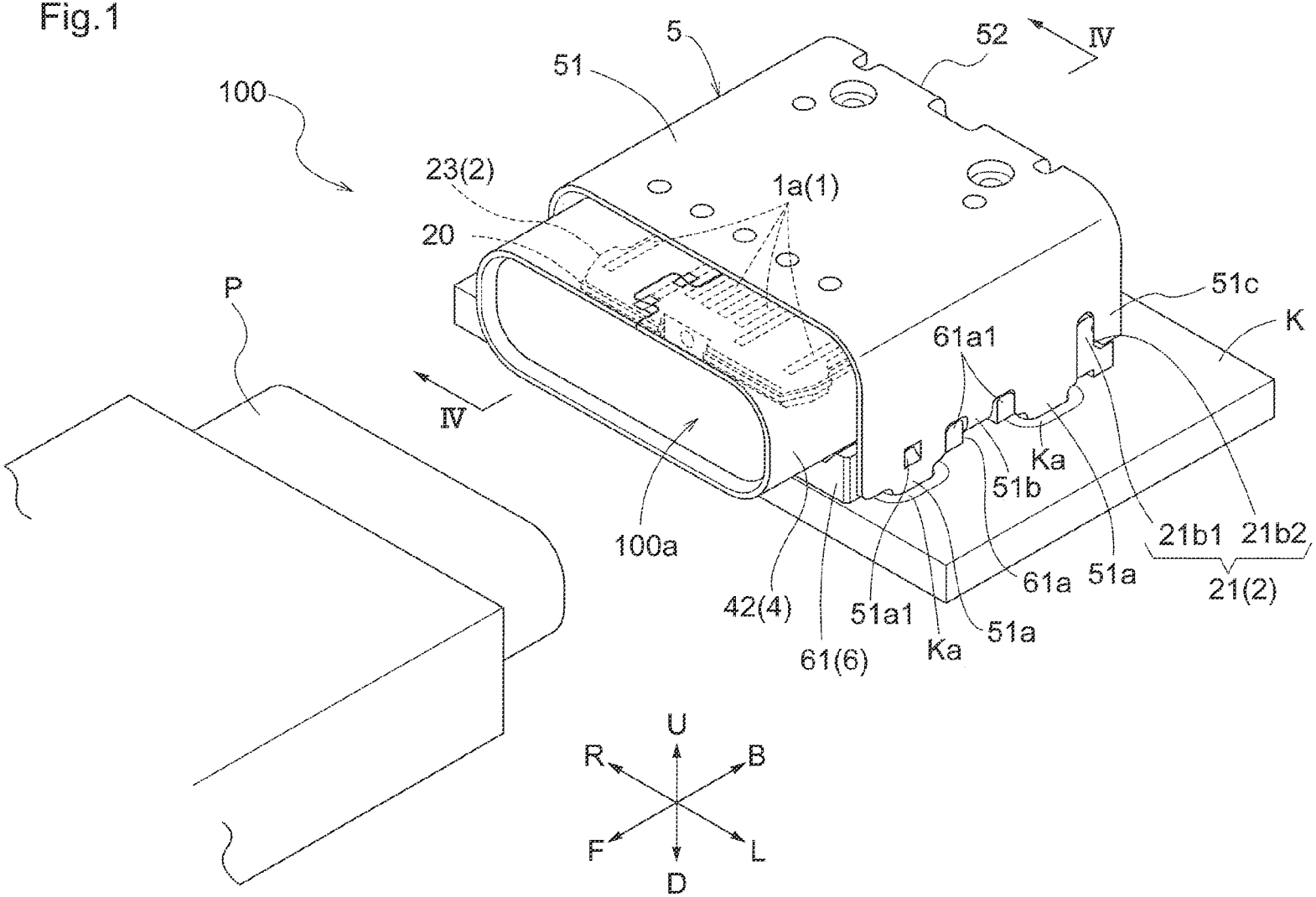
FIG. 1 is an overall perspective view of a connector.

Hereinafter, an embodiment of a connector and a connector device according to this disclosure will be described with reference to the drawings. This embodiment will describe a receptacle 100, which is mounted on a substrate K as shown in FIG. 1, as an example of the connector. However, not limited to the following embodiment, various modifications can be made without departing from the gist of the disclosure.

Figure 2:
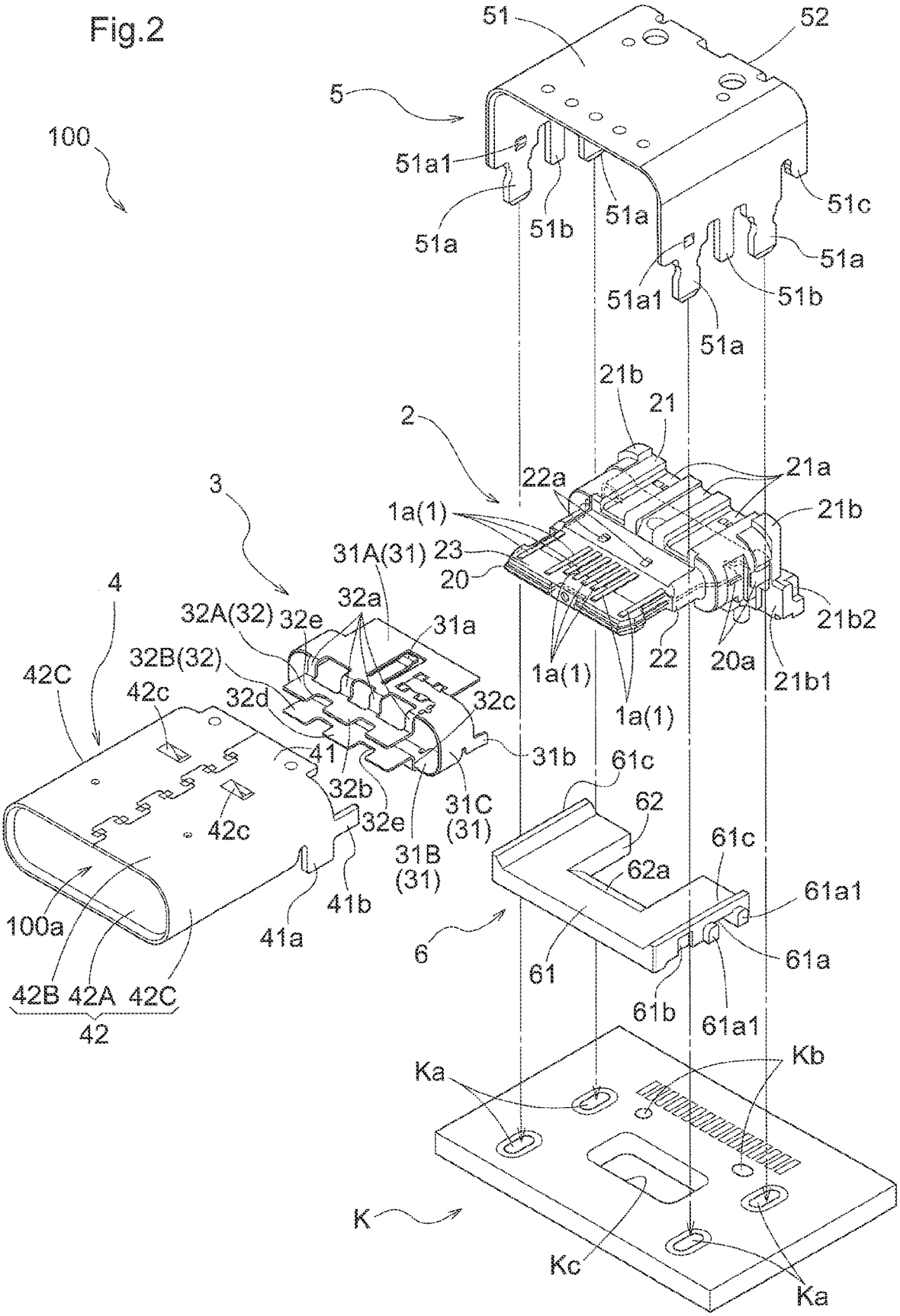
FIG. 2 is an exploded perspective view of the connector from above.
Figure 3:
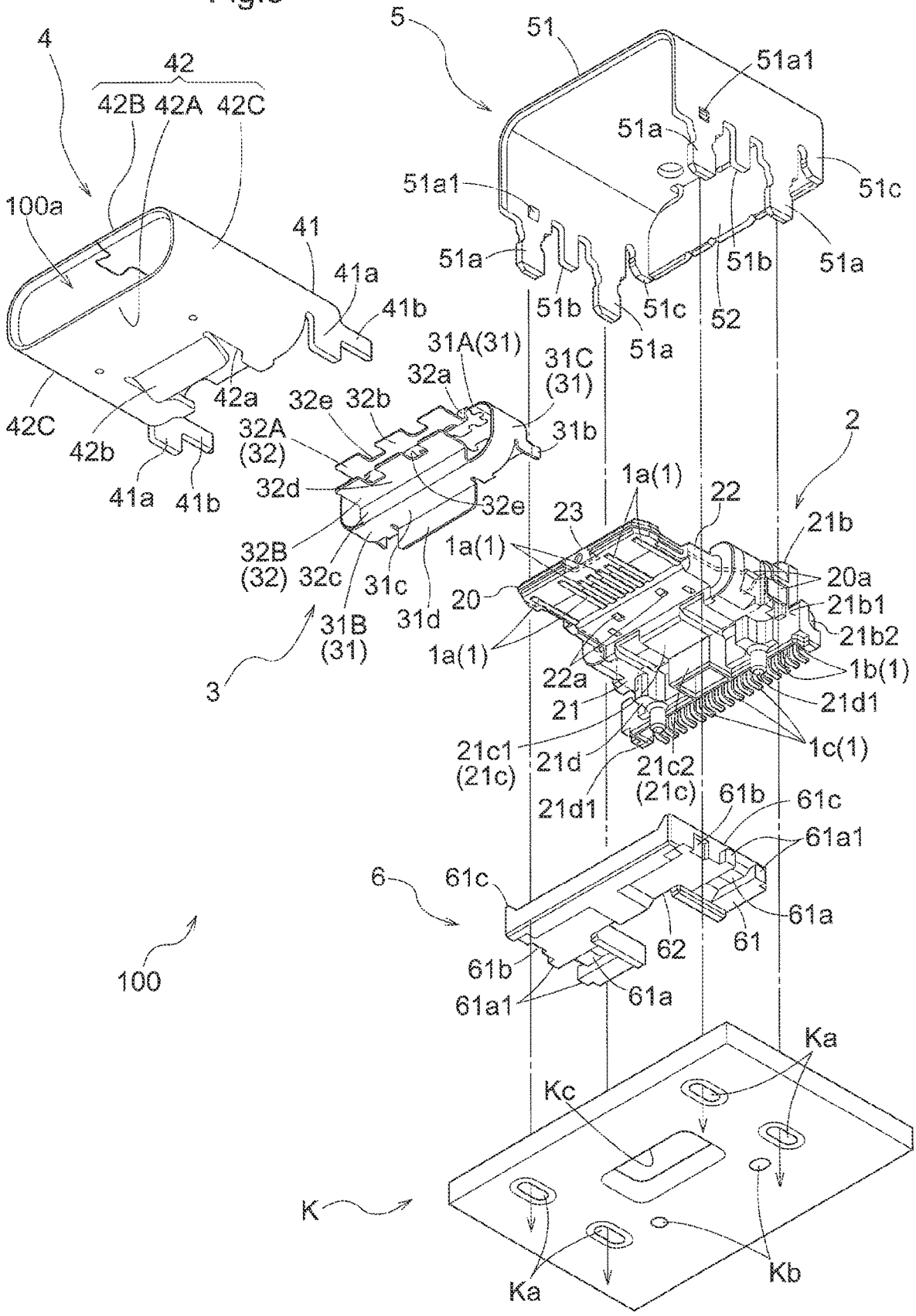
FIG. 3 is an exploded perspective view of the connector from below.
Figure 4:
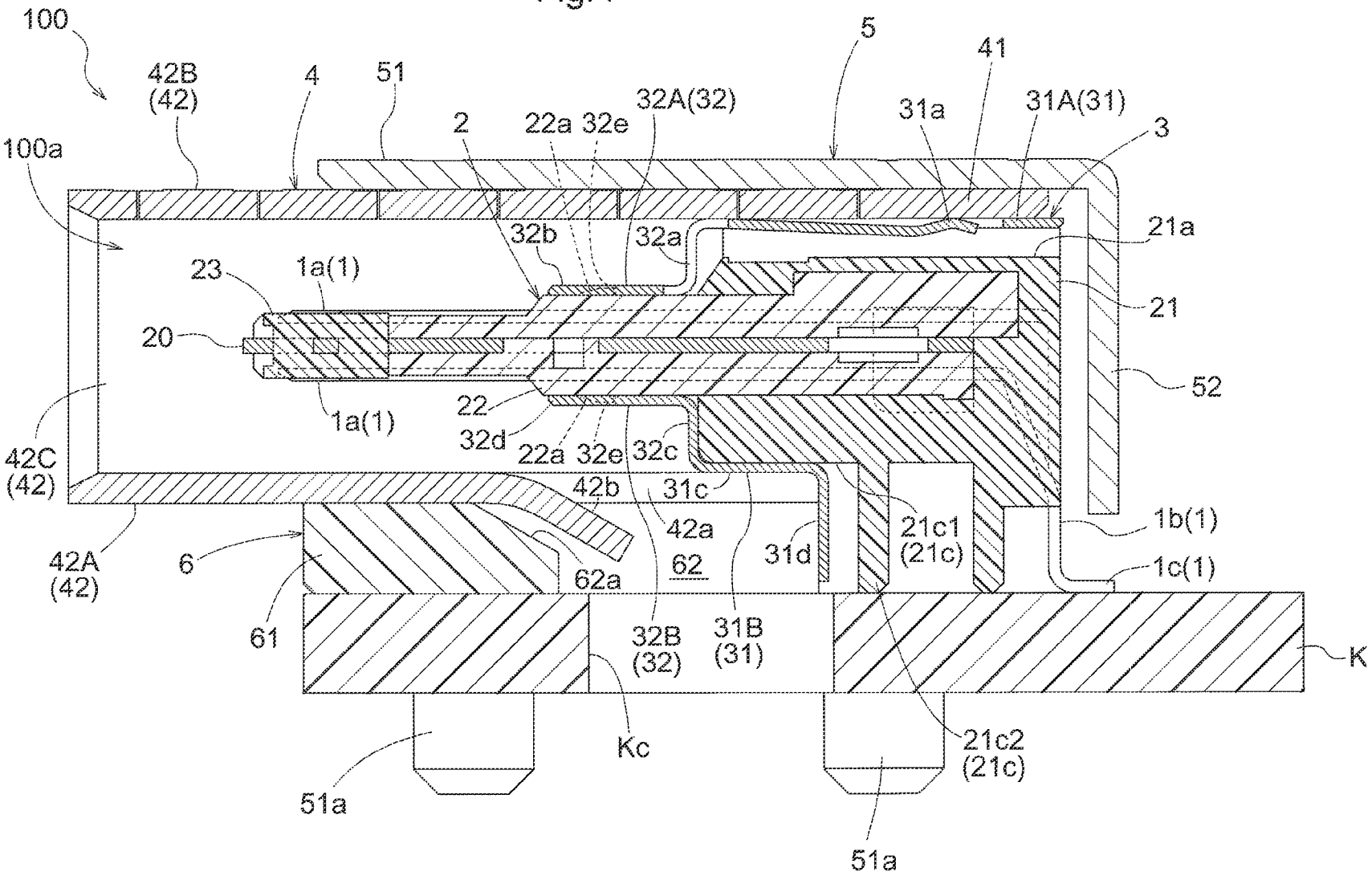
FIG. 4 is an IV-IV cross-sectional view of FIG. 1.
Figure 5:
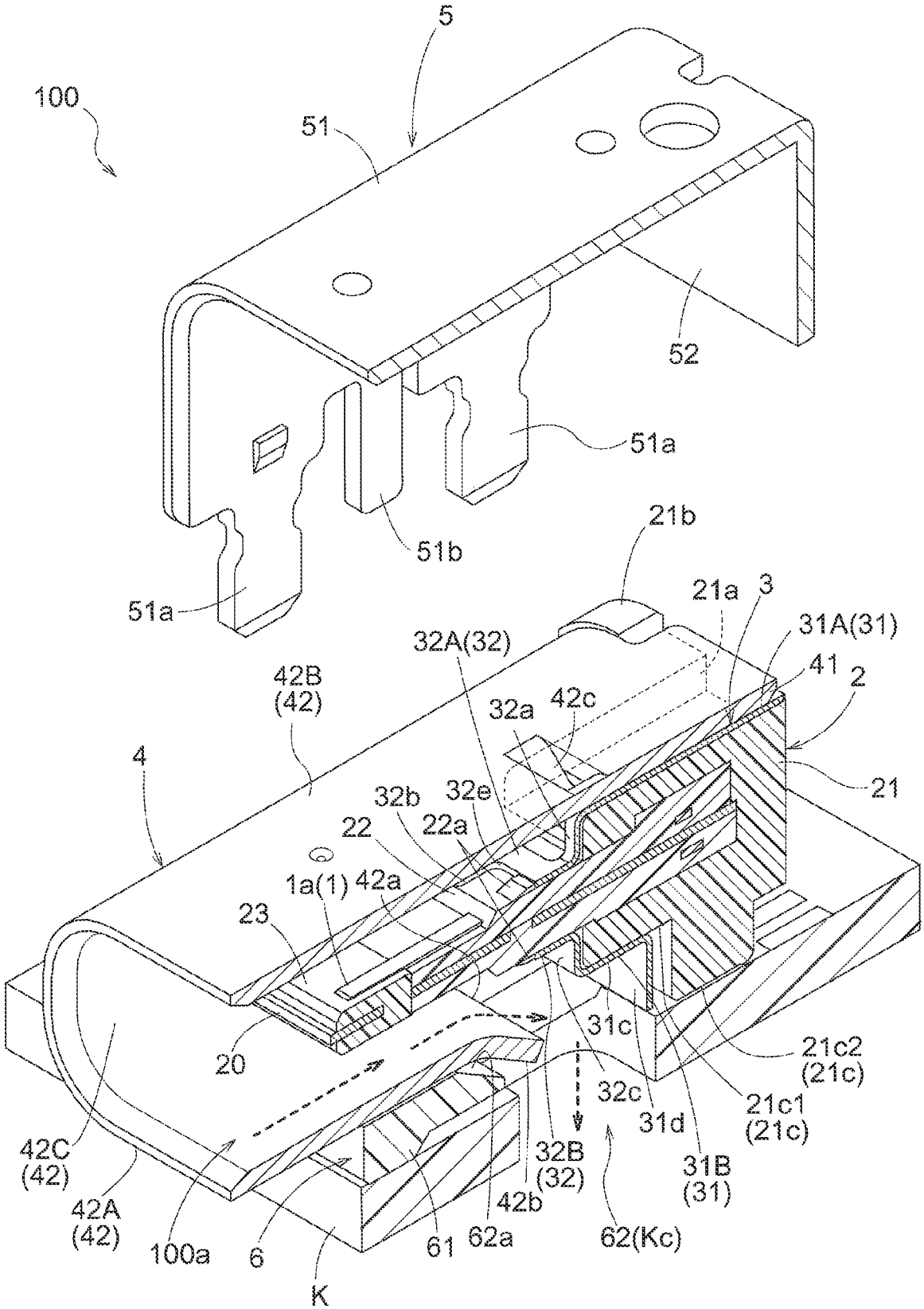
FIG. 5 is a perspective view in which the connector is partially cut out.

FIG. 1 is an overall perspective view of the receptacle 100 according to this embodiment, and FIGS. 2 and 3 are exploded perspective views of the receptacle 100 from above and below, respectively. FIG. 4 is a side cross-sectional view of the receptacle 100 (an IV-IV cross-sectional view of FIG. 1), and FIG. 5 is a perspective view in which the receptacle 100 is partially cut out in correspondence with FIG. 4. Note that the substrate K side of the receptacle 100 is defined as a gravity direction side or a lower ("D" in FIG. 1) side, the side opposite thereto as an upper ("U" in FIG. 1) side, the side on which a plug P (an example of an object to be connected) is connected as a front ("F" in FIG. 1) side, the side opposite thereto as a back ("B" in FIG. 1) side, and directions orthogonal to the vertical direction and the front-back direction as leftward ("L" in FIG. 1) and rightward ("R" in FIG. 1) directions.

As shown in FIG. 1, the receptacle 100 according to this embodiment is electrically ground-connected to the substrate K by being fixed to through holes Ka in the substrate K by means of soldering or the like. An opening 100*a* having a flat oval shape is formed on the front side of the receptacle 100, and the receptacle 100 and the plug P are electrically connected to each other by inserting the plug P into the opening 100*a*. The receptacle 100 is a small connector supporting Type-C of the USB standard, and can be inserted into the opening 100*a* even when the plug P is flipped upside down.

As shown in FIGS. 1 to 4, the receptacle 100 includes contacts 1 that are to be electrically connected to the plug P, a body 2 (an example of a first insulator) that holds the contacts 1, an EMC pad 3 (an example of a first shield member) that covers the body 2, a cover 4 (an example of a second shield member) that comes into contact with an outer face of the EMC pad 3 and covers the body 2, a shell 5 that covers the cover 4, and a spacer 6 (an example of a second insulator) arranged between the cover 4 and the substrate K, outside (below) the cover 4. The body 2 and the spacer 6 are molded with an insulating member such as resin, and the contacts 1, the EMC pad 3, the cover 4, and the shell 5 are molded with a conductive member such as metal.

As shown in FIGS. 2 to 4, a plurality of contacts 1 (a total of 16 contacts 1, including eight on the upper face of the body 2 and eight on the lower face in this embodiment) that are held horizontally symmetrically on an upper face and a lower face of the body 2 are provided. Each contact 1 has a terminal portion 1*a* that is to be electrically connected to a terminal (not shown) of the plug P, a fixed portion 1*c* that is fixed and electrically connected to the substrate K by means of soldering or the like, and a connecting portion 1*b* that electrically connects the terminal portion 1*a* to the fixed portion 1*c*. This connecting portion 1*b* has a part that is continuous with the terminal portion 1*a* and accommodated within the body 2, and a part that is bent on the back face side of the body 2 and is continuous with the fixed portion 1*c*. An end portion of the connecting portion 1*b* intersects the fixed portion 1*c*, and the fixed portion 1*c* is parallel to the substrate K.

The body 2 is an insulator that is made of resin formed by insert-molding the plurality of contacts 1 and a shield plate 20 that is made of a metal plate and arranged between an upper contact 1 group and a lower contact 1 group in order to shield the pair of contact 1 groups arranged respectively on the upper and lower faces.

The body 2 includes a base portion 21 having a block shape that internally accommodates a part of the connecting portion 1*b* of each contact 1 and exposes a part of the connecting portion 1*b* from the back face, a fitting portion 22 that internally accommodates a boundary part of the connecting portion 1*b* with the terminal portion 1*a* and to which a leading end of the plug P is externally fitted, and a protruding portion 23 that exposes the terminal portion 1*a* from the upper and lower faces and protrudes forward from the fitting portion 22, and the base portion 21, the fitting portion 22, and the protruding portion 23 are integrally formed in this order (specifically, by means of two-color molding).

A plurality of (three in this embodiment) groove portions 21*a* that are recessed downward and extend in the front-back direction are formed in the upper face of the base portion 21. Restricting portions 21*b* that restrict backward movement of the cover 4 and forward and downward movement of the shell 5 are formed protruding outward (in the upward, backward, and left-right directions) from back end portions of a pair of side faces in the left-right direction of the base portion 21. Each restricting portion 21*b* includes a front face 21*b*1 that abuts against a back end of the cover 4, and a side recessed portion 21*b*2 that engages with the shell 5. The shield plate 20 is partially exposed from the pair of side faces in the left-right direction of the base portion 21, and the shield plate 20 and the EMC pad 3 are electrically connected to each other due to exposed parts 20*a* abutting against an inner face of the EMC pad 3.

A protruding wall 21*c* having a cross section perpendicular to the left-right direction that protrudes downward in an L-shape is formed at the center portion of the lower face of the base portion 21. This protruding wall 21*c* includes a first protruding wall 21*c*1 serving as a part of the lower face, and a second protruding wall 21*c*2 having a hollow polygonal tubular shape that extends downward (toward the spacer 6 side) from the first protruding wall 21*c*1 (see FIG. 3). A pair of block portions 21*d* that protrude in a block shape are formed on left and right end portions of the lower face of the base portion 21, and column pins 21*d*1 that are inserted into positioning holes Kb in the substrate K extend downward from the block portions 21*d*. The plurality of insert-molded contacts 1 are exposed from the back face of the base portion 21.

As shown in FIGS. 2 and 3, the fitting portion 22 has a cross section perpendicular to the front-back direction that is formed in a flat oval shape, and a plurality restricting protrusions 22*a* (a total of four restricting protrusions 22*a*, including two on the upper face of the fitting portion 22 and two on the lower face in this embodiment) that restrict forward movement of the EMC pad 3 are formed on the upper and lower faces of the fitting portion 22. The protruding portion 23 has a rectangular cross section perpendicular to the front-back direction, and the terminal portions 1*a* of the plurality of insert-molded contacts 1, which are horizontally symmetrical, are exposed from the upper and lower faces of the protruding portion 23. Insert molding is conducted such that the shield plate 20 is sandwiched between the plurality of contacts 1 on the upper face and the plurality contacts 1 on the lower face.

The EMC pad 3 has a function of shielding the terminals of the plug P and the contacts 1, and is electrically connected to the shield plate 20, the cover 4, and the shell 5. The EMC pad 3 is formed by punching and bending a single metal plate, and has an annular portion 31 with a shape following the outer shape of the base portion 21, and a pair of extended portions 32 that extend forward from an upper wall 31A and a lower wall 31B of the annular portion 31. The annular portion 31 includes the upper wall 31A, the lower wall 31B, and a pair of side walls 31C that are connected to the upper wall 31A and the lower wall 31B.

The annular portion 31 has an elastic piece 31*a* formed at the center portion of the upper wall 31A, and a pair of contact pieces 31*b* that are electrically connected to the respective quadrangular exposed parts 20*a* of the shield plate 20 extend backward from the pair of side walls 31C. The lower wall 31B of the annular portion 31 includes a flat plate portion 31*c* (an example of a facing wall) and a bent wall 31*d* that is vertically bent downward (toward the spacer 6 side) from the flat plate portion 31*c*.

Of the pair of extended portions 32, a first extended portion 32A on the upper side includes a plurality of (four in this embodiment) bent pieces 32*a* that are bent from a front end of the upper wall 31A and extend downward, and one first rectangular portion 32*b* that is bent from these bent pieces 32*a* and extends forward. Of the pair of extended portions 32, a second extended portion 32B (an example of a facing wall) on the lower side includes a step portion 32*c* that is bent upward from a front end of the lower wall 31B, and a second rectangular portion 32*d* that is bent from the step portion 32*c* and extends forward. In other words, the step portion 32*c* is bent downward (toward the spacer 6 side) from the second rectangular portion 32*d*, and connects the second rectangular portion 32*d* to the flat plate portion 31*c*. The second rectangular portion 32*d*, the flat plate portion 31*c*, and the step portion 32*c* have a shape following the lower faces of the base portion 21 and the fitting portion 22 of the body 2 (see also FIG. 4). A plurality of cutout recessed portions 32*e* (a total of four cutout recessed portions 32*e*, including two on the upper face and two on the lower face in this embodiment), which restrict forward movement of the EMC pad 3 due to the restricting protrusions 22*a* of the fitting portion 22 abutting against these cutout recessed portions 32*e*, are formed at front ends of the first rectangular portion 32*b* and the second rectangular portion 32*d*.

Surfaces (at least lower faces) of the flat plate portion 31*c*, the bent wall 31*d*, the step portion 32*c*, and the second rectangular portion 32*d* according to this embodiment have been subjected to hydrophilic surface finishing, such as etching, UV irradiation, blasting, or plasma treatment.

The cover 4 has a cross section having a flat oval shape formed by punching and bending a single metal plate. The cover 4 has a contact portion 41 that comes into contact with outer faces of the upper wall 31A and the side walls 31C of the annular portion 31 of the EMC pad 3 and is electrically connected to the EMC pad 3, and a tubular portion 42 that extends forward from the contact portion 41 and has an opening 100*a* into which the plug P is to be inserted.

The contact portion 41 includes a pair of abutting portions 41*a* that abut against the front faces 21*b*1 of the restricting portion 21*b* of the body 2, and bending pieces 41*b* that extend backward from the respective abutting portions 41*a* and are bent to abut against the back face of the body 2.

The tubular portion 42 has an internal space surrounded by a lower wall 42A that faces the spacer 6, an upper wall 42B that faces the shell 5, and a pair of side walls 42C connected to the lower wall 42A and the upper wall 42B, and the fitting portion 22 and the protruding portion 23 of the body 2 are accommodated in this internal space.

The spacer 6 faces the lower wall 42A outside the tubular portion 42, and a cutout 42*a* (an example of a first communicating portion) that has a rectangular shape in a plan view (when viewed in the vertical direction) and is in communication with the outside is provided at a back end of the lower wall 42A (see FIG. 3). The lower wall 42A is also provided with an inclined wall 42*b* that is inclined toward the spacer 6 side while extending from the opening 100*a* side of the cutout 42*a* toward the side (back side) opposite to the opening 100*a* side (see FIGS. 4 and 5). In other words, the inclined wall 42*b* is inclined so as to be separated from the body 2 as the inclined wall 42*b* extends backward from a front end of the cutout 42*a*. If the receptacle 100 according to this embodiment is mounted on the substrate K with the lower wall 42A arranged on the gravity direction side, water that enters from the opening 100*a* is guided by the inclined wall 42*b* and drained to the outside.

As shown in FIGS. 2 and 3, the upper wall 42B has a pair of curved portions 42*c* that are curved inward from the upper face, enter a pair of groove portions 21*a* on respective outer sides in the left-right direction, of the three groove portions 21*a*, of the body 2, and engage between the respective pairs of bent pieces 32*a*, of the two pairs of (four) bent pieces 32*a* formed on the EMC pad 3.

The shell 5 has a U-shaped cross section formed by punching and bending a single metal plate. The shell 5 has a cover portion 51 that is electrically connected to the cover 4 by covering outer faces of the upper wall 42B and the side walls 42C of the cover 4 in contact therewith, and a back face portion 52 that is formed by bending a back end of the cover portion 51 and covers the back face of the body 2.

A pair of side walls of the cover portion 51 has a plurality of (four in this embodiment) leg portions 51*a*, which extend downward and are inserted into the through holes Ka in the substrate K and soldered. A pair of front leg portions 51*a* have engaging protrusions 51*a*1, which protrude inward and engage with the spacer 6. Each of the two side walls of the cover portion 51 also has a holding portion 51*b* that holds the spacer 6 by being bent, between the two leg portions 51*a* arranged in the front-back direction. Further, a back-end protruding portion 51*c*, which engages with the corresponding side recessed portion 21*b*2 of the body 2 to restrict forward movement of the shell 5, extends downward from a back end of each of the two side walls of the cover portion 51.

The back face portion 52 is spaced apart from the contacts 1 such that the contacts 1 are protected and the impedance of signals traveling through the contacts 1 is constant.

The spacer 6 is arranged between the cover 4 and the substrate K, and prevents flux used for soldering and solder balls from entering the receptacle 100 when the receptacle 100 is mounted on the substrate K. The spacer 6 is formed with a flat plate-shaped member, and has a U-shaped portion 61 having a U-shape in a plan view, and a rectangular recessed portion 62 (an example of a second communicating portion) located at the center portion of a back end of the U-shaped portion 61.

Engaging grooves 61*a*, with which the holding portions 51*b* of the cover portion 51 engage by being bent inward, are formed from a pair of outer side faces in the left-right direction of the U-shaped portion 61 to the lower face thereof, and two restricting protrusions 61*a*1 that restrict movement in the front-back direction of the spacer 6 are provided, protruding in the left-right direction, on respective sides of each engaging groove 61*a*. Engaging recessed portions 61*b*, with which the engaging protrusions 51*a*1 of the cover portion 51 engage, are formed on the front side of the respective engaging grooves 61*a* in the pair of side faces of the U-shaped portion 61. Further, the U-shaped portion 61 has a pair of straight protruding portions 61*c* that protrude upward from the pair of side faces, and the side walls 42C of the tubular portion 42 of the cover 4 are arranged so as to be sandwiched between these straight protruding portions 61*c*.

As shown in FIGS. 4 and 5, the rectangular recessed portion 62 overlaps with the cutout 42*a* of the lower wall 42A of the tubular portion 42 of the cover 4 in a plan view, and is in communication with the outside and the cutout 42*a*. An inclined face 62*a* that is inclined toward the substrate K side while extending from the opening 100*a* side toward the side (back side) opposite to the opening 100*a* is formed at a front end of the rectangular recessed portion 62. The inclined wall 42*b* of the lower wall 42A of the tubular portion 42 of the cover 4 is arranged along the inclined face 62*a*. The width in the left-right direction of the rectangular recessed portion 62 is larger than the width of the inclined wall 42*b* of the cover 4, and is smaller than the width of the bent wall 31*d* of the EMC pad 3. With this configuration, the bent wall 31*d* of the EMC pad 3 abuts against the back side of the U-shaped portion 61, and the inclined wall 42*b* of the cover 4 enters the front side of the rectangular recessed portion 62. A lower end of the bent wall 31*d* of the EMC pad 3 is formed slightly above a lower face of the rectangular recessed portion 62.

The substrate K has an open hole Kc that has a rectangular shape in a plan view and overlaps (in communication) with the cutout 42*a* of the cover 4 and the rectangular recessed portion 62 of the spacer 6 in a plan view. The open hole Kc has a larger plane area than the rectangular recessed portion 62. The substrate K also have a plurality of (four in this embodiment) through holes Ka, into which the plurality of leg portions 51*a* of the aforementioned shell 5 are inserted, and a plurality of (two in this embodiment) positioning holes Kb, into which the plurality of column pins 21*d*1 of the aforementioned body 2 are inserted (see FIGS. 2 and 3).

A method of assembling the receptacle 100 having the above-described configuration is as follows. As shown in FIGS. 2 and 3, first, the body 2 is manufactured in which the plurality of contacts 1 and the shield plate 20 are insert-molded. When the EMC pad 3 is then externally fitted to the body 2 from the front side, the pair of upper and lower extended portions 32 goes over the restricting protrusions 22*a* while being elastically deformed, the cutout recessed portions 32*e* then abuts against the restricting protrusions 22*a*, and the EMC pad 3 is fixed to the body 2. At this time, the pair of contact pieces 31*b* of the EMC pad 3 comes into contact with the quadrangular exposed parts 20*a* of the shield plate 20, and the EMC pad 3 and the shield plate 20 are electrically connected to each other.

Next, when the cover 4 is externally fitted from the front side to the body 2 to which the EMC pad 3 is fixed, the elastic piece 31*a* on the upper wall 31A of the EMC pad 3 abuts against the upper wall 42B of the cover 4, and is elastically deformed toward the groove portion 21*a* at the center, of the three groove portions 21*a*, of the body 2. Thus, the inner face of the cover 4 and the outer face of the EMC pad come into contact with each other, and the cover 4 and the EMC pad 3 are electrically connected to each other. Further, at this time, the pair of curved portions 42*c* of the cover 4 engage between the respective pairs of bent pieces 32*a* provided on the two sides of the EMC pad 3, and enter the corresponding groove portions 21*a* provided on the respective outer sides in the left-right direction of the body 2. The pair of bending pieces 41*b* of the cover 4 are then bent inward such that the bending pieces 41*b* abut against the back face of the body 2, and thus, the cover 4 is fixed to the EMC pad 3 and the body 2.

Next, the shell 5 is attached from above to the cover 4, the EMC pad 3, and the body 2, and the spacer 6 is attached thereto from below. Then, the engaging protrusions 51*a*1 of the leg portions 51*a* of the shell 5 are engaged with the engaging grooves 61*b* of the spacer 6, and the pair of holding portions 51*b* of the cover portion 51 are bent inward and engaged with the pair of engaging grooves 61*a* of the spacer 6. As a result, the shell 5 and the spacer 6 are fixed to the cover 4, the EMC pad 3, and the body 2, the inner face of the shell 5 and the outer face of the cover 4 come into contact with each other, and the shell 5 and the cover 4 are electrically connected to each other. When this receptacle 100 is mounted on the substrate K, the plurality of column pins 21*d*1 of the body 2 are inserted into the plurality of positioning holes Kb, and the plurality of leg portions 51*a* of the shell 5 are inserted into the plurality of through holes Ka and soldered. Then, the fixed portions 1*c* of the contacts 1 are soldered to electrodes of the substrate K, and the substrate K and the receptacle 100 are electrically connected to each other (see FIG. 1).

When the receptacle 100 is mounted on the substrate K, the cutout 42*a* of the cover 4, the rectangular recessed portion 62 of the spacer 6, and the open hole Kc in the substrate K overlap with each other in a plan view, as shown in FIG. 4. With this configuration, water that enters from the opening 100*a* of the receptacle 100 flows from the lower wall 42A of the tubular portion 42 of the cover 4 through the inclined wall 42*b* and is drained to the outside from the cutout 42*a*, the rectangular recessed portion 62, and the open hole Kc, as indicated by broken arrows in FIG. 5. At this time, the water is received by the bent wall 31*d* of the EMC pad 3 and falls in the gravity direction.

[Operation and Effect]

As described above, when the receptacle 100 is mounted on the substrate K, flux used for soldering and solder balls can be prevented from entering the inside since the spacer 6 is provided on the outer side with respect to the cover 4. Further, since the cutout 42*a* that is in communication with the outside is formed in the lower wall 42A of the cover 4, and the rectangular recessed portion 62 that is in communication with the outside and the cutout 42*a* is formed in the spacer 6, water that enters from the opening 100*a* of the tubular portion 42 of the cover 4 can be drained to the outside from the cutout 42*a* and the rectangular recessed portion 62.

Moreover, since the EMC pad 3 has the facing walls (the flat plate portion 31*c* and the second extended portion 32B) that face the cutout 42*a*, water that enters from the opening 100*a* of the tubular portion 42 is blocked by the facing walls (the flat plate portion 31*c* and the second extended portion 32B), and can be drained to the outside from the cutout 42*a* and the rectangular recessed portion 62, while suppressing entry of the water to the contact 1 side. Further, since the EMC pad 3 has the bent wall 31*d* that extends from the flat plate portion 31*c*, i.e., from an end portion of one facing wall on the opposite side to the opening 100*a*, and is bent toward the spacer 6 side, water that moves along the facing walls (the flat plate portion 31*c* and the second extended portion 32B) can be guided to the cutout 42*a* and the rectangular recessed portion 62 by the bent wall 31*d*.

Since the lower wall 42A of the cover 4 is provided with the inclined wall 42*b* that is inclined toward the spacer 6 side while extending from the opening 100*a* side toward the opposite side, the water guided by the inclined wall 42*b* smoothly falls and can be reliably drained from the cutout 42*a* and the rectangular recessed portion 62. Further, since the step portion 32*c* is provided on the facing walls (the flat plate portion 31*c* and the second extended portion 32B), water that moves along the facing walls (the flat plate portion 31*c* and the second extended portion 32B) is guided toward the spacer 6 side by the step portion 32*c*, and can be smoothly drained from the cutout 42*a* and the rectangular recessed portion 62. Moreover, if the surfaces (at least lower faces) of the facing walls (the flat plate portion 31*c* and the second extended portion 32B) and the bent wall 31*d* are hydrophilic, water is likely to be attracted to the facing walls (the flat plate portion 31*c* and the second extended portion 32B) and the bent wall 31*d*, and can be reliably drained from the cutout 42*a* and the rectangular recessed portion 62.

A charger X that includes the receptacle 100 mounted on the substrate K, as shown in FIGS. 7 to 10, will be described as an example of a connector device below. Note that the connector device is not limited to the charger X, and can be applied to any device such as a communication device.

Figure 7:
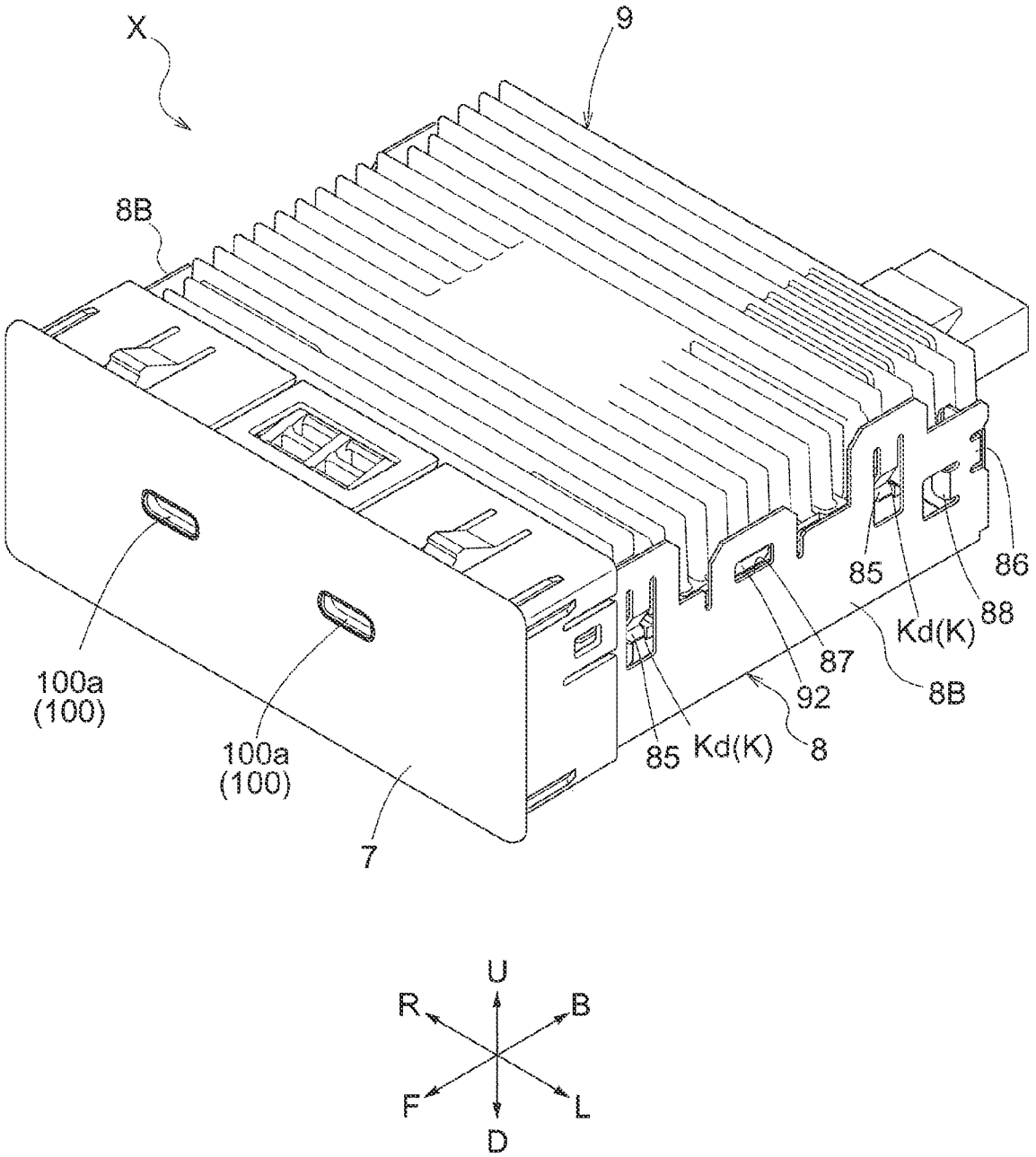
FIG. 7 is an overall perspective view of a connector device.
Figure 8:
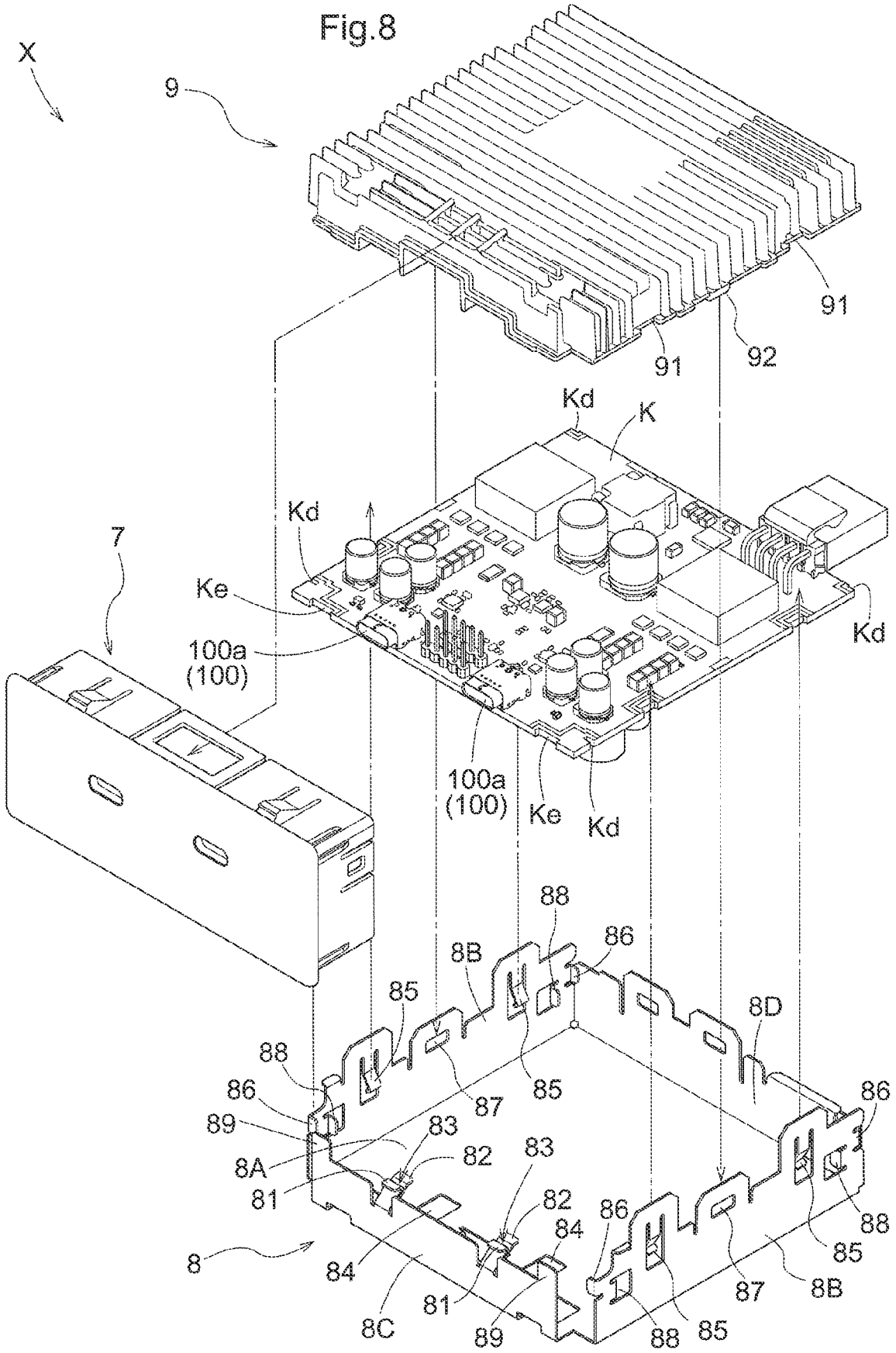
FIG. 8 is an exploded perspective view of the connector device.

As shown in FIGS. 7 and 8, the charger X includes the above-described receptacle 100, the substrate K on which a plurality of (two in this embodiment) receptacles 100 are mounted, a front shield 7 that covers the receptacles 100 such that the openings 100*a* are visible from the outside, a bottom shield 8 (an example of a case) that supports the substrate K, and a fin unit 9 that dissipates heat generated from electronic components mounted on the substrate K. A lower face of the substrate K, i.e., a face thereof on the opposite side to the side on which the receptacles 100 are mounted, is supported by the bottom shield 8. The front shield 7 is formed with a conductive member such as metal, and covers the entirety of the receptacles 100 and front parts of the substrate K, the bottom shield 8, and the fin unit 9.

The bottom shield 8 is formed with a conductive member such as metal, and supports the substrate K and the fin unit 9. The bottom shield 8 is formed of a bottom wall 8A, a pair of side walls 8B, a front wall 8C, and a back wall 8D. The bottom wall 8A has a plurality of (two in this embodiment) rectangular drain holes 84 for draining water out of the bottom shield 8, and a pair of small holes 84*a* are formed on the front side of the respective drain holes 84 (see also FIG. 10). First bent pieces 82 are connected to front ends of the pair of drain holes 84. Each of the two side walls 8B has a plurality of (two in this embodiment) engaging pieces 85 that engage with cutouts 91 of the fin unit 9, a plurality of (two in this embodiment) insertion pieces 86 that are inserted into cutouts Kd of the substrate K, a fitting hole 87 into which a corresponding protruding portion 92 of the fin unit 9 is fitted, and a plurality of (two in this embodiment) abutting pieces 88 that abut against the lower face of the lower face of the substrate K.

The front wall 8C has a pair of second bent pieces 81 that are bent to face the first bent pieces 82. The front wall 8C also has a plurality of (two in this embodiment) protruding pieces 89 that are inserted into cutouts Ke of the substrate K. When the substrate K is attached to the bottom shield 8, the insertion pieces 86 and the protruding pieces 89 are inserted respectively into the plurality of (four in this embodiment) cutouts Kd and the plurality of (two in this embodiment) cutouts Ke of the substrate K to position the substrate K, and the substrate K is supported by the bottom shield 8 due to the plurality of (four in this embodiment) abutting pieces 88 abutting against the lower face of the substrate K. When the fin unit 9 is attached to the bottom shield 8, the engaging pieces 85 engage with the cutouts 91 of the fin unit 9 to position the fin unit 9, and the fin unit 9 is supported by the bottom shield 8 due to the protruding portions 92 of the fin unit 9 being fitted into the fitting holes 87.

Figure 9:
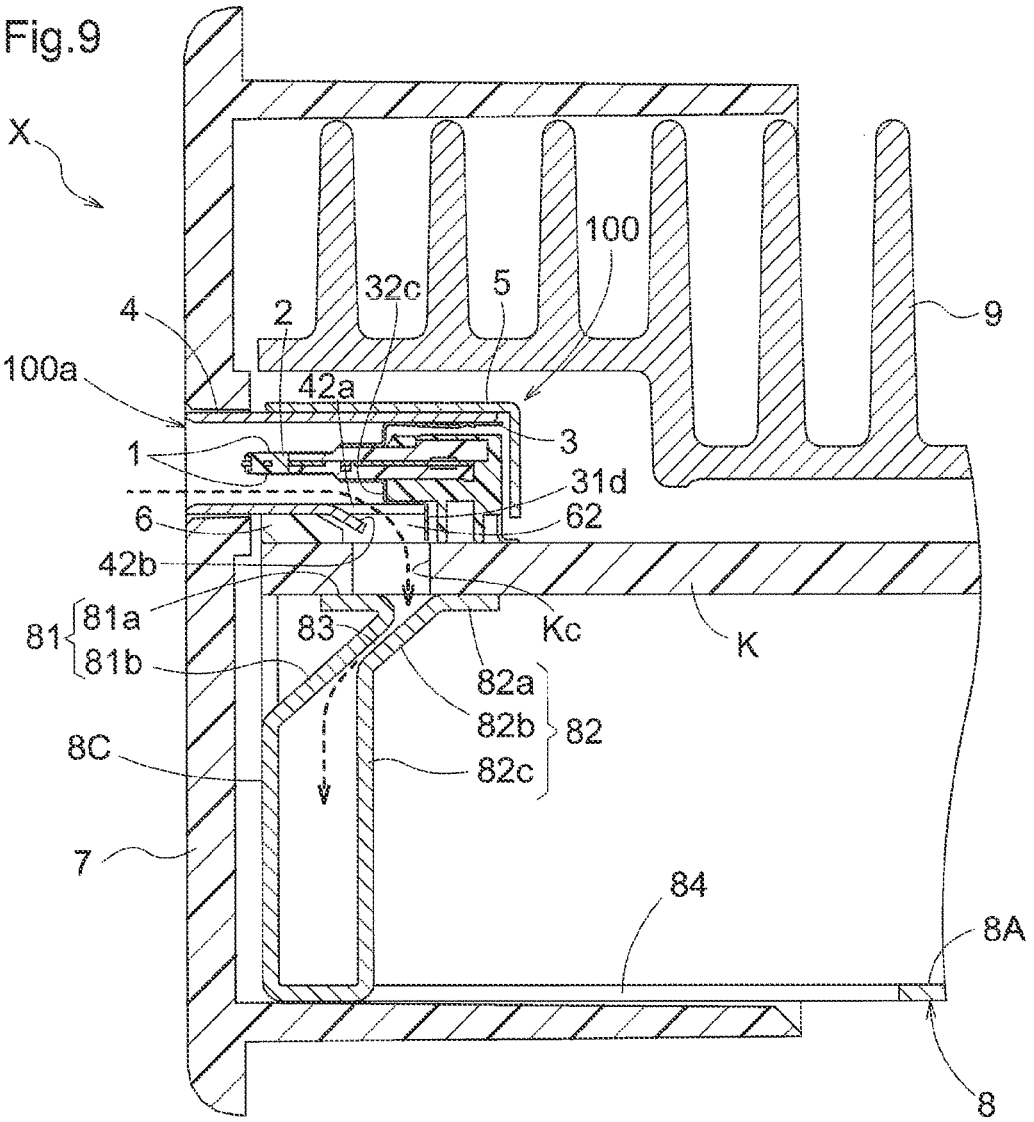
FIG. 9 is a cross-sectional view of the connector device.
Figure 10:
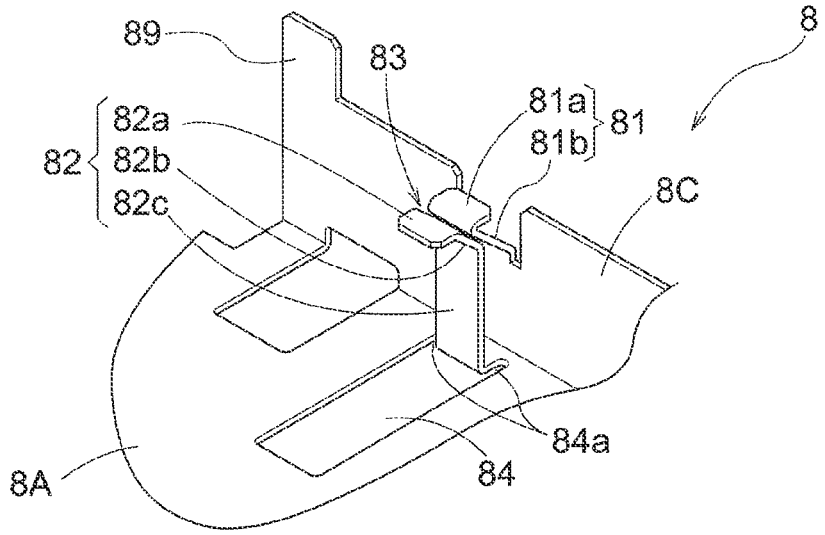
FIG. 10 is an enlarged perspective view of a suction path of the connector device.

As shown in FIGS. 9 and 10, each first bent piece 82 has a first horizontal portion 82*a* that extends parallel to the lower face of the substrate K, a first inclined portion 82*b* that is inclined downward from the first horizontal portion 82*a* toward the front wall 8C, and a vertical portion 82*c* perpendicular to the bottom wall 8A. The first horizontal portion 82*a*, the first inclined portion 82*b*, and the vertical portion 82*c* are integrally formed. Each second bent piece 81 has a second horizontal portion 81*a* that extends parallel to the lower face of the substrate K, and a second inclined portion 81*b* that is inclined downward from the second horizontal portion 81*a* toward the front wall 8C. The second horizontal portion 81*a* and the second inclined portion 81*b* are integrally formed. The substrate K is supported by the first horizontal portion 82*a* and the second horizontal portion 81*a*, and a narrow suction path 83 is formed between the first inclined portion 82*b* of each first bent piece 82 and the second inclined portion 81*b* of the corresponding second bent piece 81 that face each other. This suction path 83 suctions water drained from the open hole Kc in the substrate K, utilizing the capillary phenomenon. The water suctioned by the suction path 83 is drained out of the bottom shield 8 from the drain holes 84 in the bottom wall 8A.

[Operation and Effect]

As described above, since the suction path 83 is provided that suctions water drained from the open hole Kc in the substrate K, utilizing the capillary phenomenon, the water guided to the cutout 42*a* and the rectangular recessed portion 62 by the bent wall 31*d* of the receptacle 100 can be forcibly suctioned from the open hole Kc via the suction path 83. Since the water suctioned by the suction path 83 is quickly drained out of the bottom shield 8 from the drain holes 84, it is possible to prevent inconveniences such as water staying in the receptacle 100 and the substrate K.

[Other Embodiments]

Figure 6:
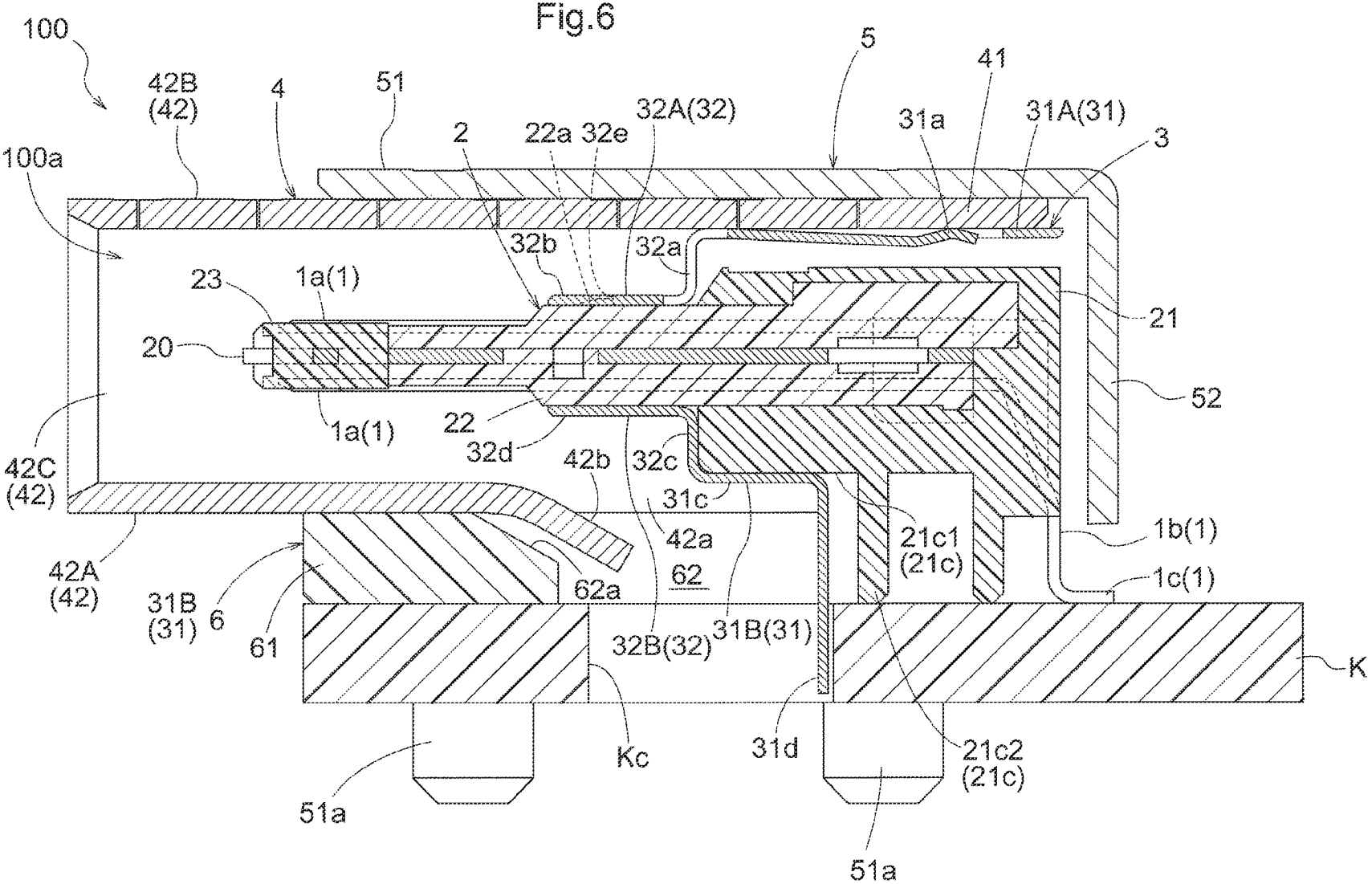
FIG. 6 is a cross-sectional view of the connector according to another embodiment.

(1) The bent wall 31*d* of the EMC pad 3 may extend to the outside with respect to the rectangular recessed portion 62 of the spacer 6, as shown in FIG. 6. That is to say, the bent wall 31*d* may enter the open hole Kc in the substrate K. If the bent wall 31*d* thus extends to the outside with respect to the rectangular recessed portion 62, when the receptacle 100 is mounted on the receptacle 100, water can be prevented from entering between the receptacle 100 and the substrate K.

(2) Although the cover 4 is provided with the inclined wall 42*b* in the above embodiment, the inclined wall 42*b* may be omitted, and the inclined wall 42*b* may have any shape such as a stepped shape.

(3) Although the second extended portion 32B on the lower side of the EMC pad 3 is provided with the step portion 32*c* in the above embodiment, the second extended portion 32B may be formed as a flat surface without the step portion 32*c*, or may be provided with a plurality of steps.

(4) Although the above embodiment has described the case of mounting the receptacle 100 on the substrate K, the receptacle 100 may be introduced into a device in a stand-alone manner. In this case, a structure that is in communication with the cutout 42*a* and the rectangular recessed portion 62 such that water can be drained to the outside is provided on the device side.

(5) Although the receptacle 100 has been described as an example of a connector in the above embodiment, the embodiment may alternatively be applied to any other connector, such as a plug.

(6) Although water is drained from the front side of the bottom shield 8 in the above-described embodiment, the suction path 83 may be extended to the back side of the bottom shield 8 to drain water.

(7) An absorbent material that absorbs water may be provided near the drain holes 84. A configuration may alternatively be employed in which the drain holes 84 are omitted and an absorbent material is provided below each suction path 83.

The invention claimed is:

1. A connector comprising:

a contact to be electrically connected to an object to be connected;

a first insulator that holds the contact;

a first shield member that covers the first insulator;

a second shield member that comes into contact with an outer face of the first shield member and has a tubular portion having an opening into which the object to be connected is to be inserted; and a second insulator arranged on an outer side of the second shield member, wherein a first communicating portion that is in communication with an outside of the connector is formed in a lower wall of the tubular portion of the second shield member, the lower wall facing the second insulator, a second communicating portion that is in communication with the outside of the connector and the first communicating portion is formed in the second insulator, and the first shield member has a facing wall that faces the first communicating portion, and a bent wall that is bent toward the second insulator side from an end portion of the facing wall on an opposite side to the opening.

2. The connector according to claim 1, wherein the lower wall of the second shield member is provided with an inclined wall that is inclined toward the second insulator side while extending from the opening side of the first communicating portion toward the opposite side.

3. The connector according to claim 1, wherein a step portion that is bent toward the second insulator side is formed in the facing wall.

4. The connector according to claim 2, wherein a step portion that is bent toward the second insulator side is formed in the facing wall.

5. The connector according to claim 1, wherein the bent wall extends to the outside with respect to the second communicating portion.

6. The connector according to claim 2, wherein the bent wall extends to the outside with respect to the second communicating portion.

7. The connector according to claim 3, wherein the bent wall extends to the outside with respect to the second communicating portion.

8. The connector according to claim 4, wherein the bent wall extends to the outside with respect to the second communicating portion.

9. The connector according to claim 1, wherein the facing wall and the bent wall include hydrophilic surfaces.

10. The connector according to claim 2, wherein the facing wall and the bent wall include hydrophilic surfaces.

11. The connector according to claim 3, wherein the facing wall and the bent wall include hydrophilic surfaces.

12. The connector according to claim 4, wherein the facing wall and the bent wall include hydrophilic surfaces.

13. The connector according to claim 5, wherein the facing wall and the bent wall include hydrophilic surfaces.

14. The connector according to claim 6, wherein the facing wall and the bent wall include hydrophilic surfaces.

15. The connector according to claim 7, wherein the facing wall and the bent wall include hydrophilic surfaces.

16. A connector device including the connector according to claim 1, the device comprising:

a substrate on which the connector is mounted and in which an open hole that is in communication with the first communicating portion and the second communicating portion is formed; and a case that supports the substrate on an opposite side to a side on which the connector is mounted, wherein the case has a suction path that suctions water drained from the open hole utilizing a capillary phenomenon, and the water is drained out of the case via the suction path.

17. A connector device including the connector according to claim 2, the device comprising:

a substrate on which the connector is mounted and in which an open hole that is in communication with the first communicating portion and the second communicating portion is formed; and a case that supports the substrate on an opposite side to a side on which the connector is mounted, wherein the case has a suction path that suctions water drained from the open hole utilizing a capillary phenomenon, and the water is drained out of the case via the suction path.

18. A connector device including the connector according to claim 3, the device comprising:

a substrate on which the connector is mounted and in which an open hole that is in communication with the first communicating portion and the second communicating portion is formed; and a case that supports the substrate on an opposite side to a side on which the connector is mounted, wherein the case has a suction path that suctions water drained from the open hole utilizing a capillary phenomenon, and the water is drained out of the case via the suction path.

19. A connector device including the connector according to claim 5, the device comprising:

a substrate on which the connector is mounted and in which an open hole that is in communication with the first communicating portion and the second communicating portion is formed; and a case that supports the substrate on an opposite side to a side on which the connector is mounted, wherein the case has a suction path that suctions water drained from the open hole utilizing a capillary phenomenon, and the water is drained out of the case via the suction path.

20. A connector device including the connector according to claim 9, the device comprising:

a substrate on which the connector is mounted and in which an open hole that is in communication with the first communicating portion and the second communicating portion is formed; and a case that supports the substrate on an opposite side to a side on which the connector is mounted, wherein the case has a suction path that suctions water drained from the open hole utilizing a capillary phenomenon, and the water is drained out of the case via the suction path.

* * * * *